US009164411B2

(12) United States Patent
Nakamura et al.

(10) Patent No.: US 9,164,411 B2
(45) Date of Patent: Oct. 20, 2015

(54) CARRIER CORE MATERIAL FOR ELECTROPHOTOGRAPHIC DEVELOPER, METHOD FOR MANUFACTURING THE SAME, CARRIER FOR ELECTROPHOTOGRAPHIC DEVELOPER AND ELECTROPHOTOGRAPHIC DEVELOPER

(75) Inventors: Masahiro Nakamura, Okayama (JP); Takeshi Kawauchi, Okayama (JP); Toshiya Kitamura, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 157 days.

(21) Appl. No.: 13/381,570

(22) PCT Filed: Jun. 28, 2010

(86) PCT No.: PCT/JP2010/060982
§ 371 (c)(1),
(2), (4) Date: Mar. 16, 2012

(87) PCT Pub. No.: WO2011/001940
PCT Pub. Date: Jan. 6, 2011

(65) Prior Publication Data

US 2012/0208121 A1 Aug. 16, 2012

(30) Foreign Application Priority Data

Jun. 29, 2009 (JP) ..... 2009-154144

(51) Int. Cl.
*G03G 9/107* (2006.01)
*G03G 9/113* (2006.01)

(52) U.S. Cl.
CPC ..... *G03G 9/107* (2013.01); *G03G 9/1075* (2013.01); *G03G 9/1136* (2013.01)

(58) Field of Classification Search
CPC ..... G03G 9/107; G03G 9/1075; G03G 9/113
USPC ..... 430/111.31, 111.32, 111.33, 137.1, 430/137.13; 252/62.64; 423/274, 594.1
See application file for complete search history.

(56) References Cited

FOREIGN PATENT DOCUMENTS

| | | |
|---|---|---|
| JP | A-60-227265 | 11/1985 |
| JP | A-07-020658 | 1/1995 |
| JP | A-11-194585 | 7/1999 |
| JP | A-2001-093720 | 4/2001 |
| JP | A-2008-096977 | 4/2008 |

OTHER PUBLICATIONS

International Search Report in International Application No. PCT/JP2010/060982; dated Jul. 20, 2010 (with English-language translation).

*Primary Examiner* — Janis L Dote
(74) *Attorney, Agent, or Firm* — Oliff PLC

(57) ABSTRACT

There is provided a carrier core material for electrophotographic developer containing a soft ferrite, expressed by $(Mg_XMn_{1-X})Fe_2O_4$ (wherein X is in a range of $0.1 \leq X < 1.$), wherein an analysis value of P on the surface of the carrier core material is 0.1 mass % or more, an analysis value of Mg is 2 mass % or more, a content of Mg on the surface of the carrier core material is 2 mass % or more by EDS, and when the content of Mg in the carrier core material is expressed by M1, and the analysis value of Mg on the surface of the carrier core material by EDS is expressed by M2, a value of M2/M1 exceeds 1.0.

4 Claims, 8 Drawing Sheets

(a) (b) (c)

(a) (b) (c)

(a) (b) (c)

(a) (b) (c)

(a) (b) (c)

(a) (b) (c)

(a) (b) (c)

(a) (b) (c)

(a) (b) (c)

(a) (b) (c)

CARRIER CORE MATERIAL FOR ELECTROPHOTOGRAPHIC DEVELOPER, METHOD FOR MANUFACTURING THE SAME, CARRIER FOR ELECTROPHOTOGRAPHIC DEVELOPER AND ELECTROPHOTOGRAPHIC DEVELOPER

TECHNICAL FIELD

The present invention relates to a carrier core material for electrophotographic developer, and a method for manufacturing the same, a carrier for electrophotographic developer and an electrophotographic developer.

DESCRIPTION OF RELATED ART

Conventionally, as an electrophotographic developing method used in a copying machine or a printer, etc., a cascade method, a magnetic brush developing method, and other methods are used. In recent years, the magnetic brush developing method is a general means, which is the method for eliciting a toner image from an electrostatic latent image formed on a photosensitive drum via a magnetic brush, then fixing the toner image under heat to thereby obtain an image. Further in recent years, a two-component developer is frequently used, which is the developer in which a toner is electrostatically oriented on particles of a carrier for electrophotographic developer (described as a "carrier" in some cases in the present invention), with the magnetic brush formed in this carrier.

In the two-component developer, as carrier particles constituting the carrier, the carrier particles with a surface of a core material constituting the carrier particles (described as "a carrier core material" in some cases in the present invention.) coated with suitable amount of resin whose polarity is opposite to that of the toner, is frequently used. Toner particles are electrified by mixing and stirring the carrier particles and the toner particles in a developing machine, so that the electrified toner particles are adhered to the carrier particles. Next, the electrified toner particles are moved to the electrostatic latent image formed on a photoreceptor or an electrostatic recording material and adhered thereto, from the magnetic brush formed by the carrier particles. The image can be obtained by developing the electrostatic latent image.

In a developing method by the two-component developer using the carrier particles and the toner particles as described above, the toner particles move to the photoreceptor from the magnetic brush every time developing is performed. Therefore, insufficient toner particles are rapidly replenished, and mixing and stirring with the carrier particles are performed again, so that repeated developing can be performed. Therefore, formation of the image is largely influenced by charging amounts of the carrier particles and toner.

However, the carrier particles stay in the developing machine and are used repeatedly, while the toner particles are supplied or consumed every time developing is performed and are always replaced by new toner particles.

Further, in a case of a high charging amount of the carrier particles, there are lots of merits in the developing machine itself. For example, required amount of carrier particles can be reduced by using a carrier having high charging amount. Thus, weights of the developing machine can be reduced, and a load added to a magnetic drum can also be reduced.

In order to increase the charging amount of the carrier particles, generally the kind and thickness of the resin for coating the carrier core material is changed or a suitable additive, etc., is added.

Meanwhile, characteristics of the carrier core material are also influenced by characteristics of the carrier core material itself.

For example, patent document 1 proposes to reduce a stress among carrier particles and maintain the charging amount of the carrier particles by improving uniformity of particles by arranging grain sizes of particles.

Further, patent documents 2, 3 propose to control an electric resistance value by adding phosphorus (P) to the carrier core material, or control a saturation magnetization value.

PRIOR ART DOCUMENTS

Patent Documents

Patent document 1: Japanese Patent Laid Open Publication No. 2008-96977

Patent document 2: Japanese Patent Laid Open Publication No. 1995-20658

Patent document 3: Japanese Patent Laid Open Publication No. 2001-93720

SUMMARY OF THE INVENTION

Problem to be Solved by the Invention

However, according to an examination by inventors of the present invention, it is found that a resin coating film of the carrier particles is partially chipped or peeled-off in some cases, by a long-time use of an electrophotographic developing machine. When such chipping or peeling-off is generated, the carrier core material is partially exposed in the carrier particles to thereby reduce the charging amount, resulting in reduction of an image quality due to reduction of toner adhesion.

Further, according to the examination of the inventors of the present invention, it is also found that when the resin for coating the surface is peeled-off due to wear of the carrier particles under long-time use, the charging amount of the carrier particles are hardly maintained, even if the techniques of patent documents 1 to 3 are used.

In view of the above-described problems of the conventional techniques, the present invention is provided, and an object of the present invention is to provide a carrier core material for electrophotographic developer with a long life, capable of maintaining high charging amount or capable of maintaining prescribed charging amount even under long-time use, a carrier core material for electrophotographic developer that constitutes the carrier for electrophotographic developer and a method for manufacturing the same, and an electrophotographic developer using the carrier for electrophotographic developer.

Means for Solving the Problem

In order to solve the above-described problem, after strenuous efforts by the inventors of the present invention, the following matter is found. Namely, it is considered to be an inevitable phenomenon that the resin coating the carrier core material is partially peeled-off, and therefore a breakthrough change of idea from a different angle is carried out, such that a long life carrier for electrophotographic developer capable of maintaining high charging amount even under long-time use can be obtained even in a case of the carrier particles with the coating resin partially peeled-off, provided that the carrier capable of maintaining prescribed charging amount can be manufactured.

Based on the aforementioned idea, the inventors of the present invention achieves the carrier capable of maintaining prescribed charging amount even in a case that coated resin is partially peeled-off, by increasing the charging amount of the carrier core itself.

Meanwhile, the inventors of the present invention obtains a knowledge that Mg and P can be precipitated on the surface of the carrier core material by containing phosphorus (described as "P" in some cases in this invention) in the carrier core material containing Mg ferrite, and also obtains a knowledge that by separating Mg and P on the surface of the carrier core material, the charging amount of the carrier core material itself can be increased and a desired charging amount can be given to the carrier core material itself. Thus, the present invention is completed.

Namely, in order to solve the above-described problem, a first invention provides a carrier core material for electrophotographic developer containing a soft ferrite, expressed by $(Mg_XMn_{1-X})Fe_2O_4$ (wherein X is in a range of $0.1 \leq X < 1$.), wherein an analysis value of P on the surface of the carrier core material is 0.1 mass % or more, an analysis value of Mg is 2 mass % or more, a content of Mg in the carrier core material is 2 mass % or more by EDS, and when the content of Mg in the carrier core material is expressed by M1, and the analysis value of Mg on the surface of the carrier core material by EDS is expressed by M2, a value of M2/M1 exceeds 1.0.

A second invention provides a carrier core material for electrophotographic developer containing a soft ferrite expressed by $(Mg_YFe_{3-Y})O_4$ (wherein Y is in a range of $0.1 \leq Y \leq 1$), wherein an analysis value of P on the surface of the carrier core material is 0.1 mass % or more, and an analysis value of Mg is 2 mass % or more by EDS, and when a content of Mg in the carrier core material is expressed by M1, and an analysis value of Mg on the surface of the carrier core material by EDS is expressed by M2, a value of M2/M1 exceeds 1.0.

A third invention provides a method for manufacturing a carrier core material for electrophotographic developer, comprising:

weighing 0.1 to 10 mass % of P-source in terms of element P, weighing 1.0 to 12 mass % of Mg-source in terms of element Mg, and weighing $Fe_2O_3$ with average particle size $D_{50}$ being 1.0 μm or more as a remaining portion;

adding and mixing into a solvent, the weighed P-source, and the weighed $Fe_2O_3$ with average particle size $D_{50}$ being 1.0 μm or more, and the weighed Mg-source, and converting them into slurry;

spraying the slurry into a hot blast, and obtaining granulated dry powder;

sintering the granulated dry powder; and applying heat treatment to the sintered granulated dry powder under a prescribed condition.

A fourth invention provides a method for manufacturing a carrier core material for electrophotographic developer, comprising:

weighing 0.1 to 10 mass % of P-source in terms of element P, and weighing 2.5 to 25 mass % of Mn-source in terms of element Mn, and weighing 1.0 to 12 mass % of Mg-source in terms of element Mg, and weighing $Fe_2O_3$ with average diameter $D_{50}$ being 1.0 μm or more as a remaining portion;

adding and mixing into a solvent the weighed P-source, and the weighed $Fe_2O_3$ with average particle size $D_{50}$ being 1.0 μm or more, and the weighed Mn-source, and the weighed Mg-source, and converting them into slurry;

spraying the slurry into a hot blast and obtaining granulated dry powder;

sintering the granulated dry powder; and applying heat treatment to the sintered granulated dry powder under a prescribed condition.

A fifth invention provides the method for manufacturing a carrier core material for electrophotographic developer according to the third or fourth invention, wherein one or more kinds of compounds are used, selected from red phosphorus as the P-source, $MnCO_3$ and/or $Mn_3O_4$ as the Mn-source, and selected from MgO, $Mg(OH)_2$, $MgCO_3$ as the Mg-source.

A sixth invention provides a carrier for electrophotographic developer, wherein the carrier core material for electrophotographic developer of the first or the second invention is coated with thermosetting resin.

A seventh invention provides an electrophotographic developer, comprising: the carrier for electrophotographic developer of the sixth invention, and a suitable toner.

Advantage of the Invention

According to the present invention, even if a resin film on the surface of the carrier particles is worn or peeled-off, due to a long-time use of the carrier, a transfer amount of the toner particles to the photoreceptor is not reduced, and the deterioration of the image quality can be prevented.

DETAILED DESCRIPTION OF THE INVENTION

Figure 1:
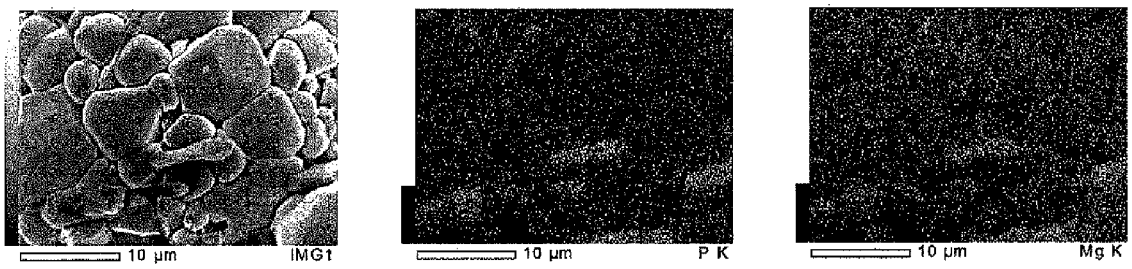
FIG. 1 shows a SEM image of a carrier core material, and a mapping image of P and Mg, according to example 1.

A carrier core material constituting a carrier according to the present invention, is mainly composed of a soft ferrite expressed by a general formula $(Mg_XMn_{1-X})Fe_2O_4$ (wherein X is in a range of $0.1 \leq X < 1$), or is mainly composed of a soft ferrite expressed by a general formula $(Mg_YFe_{3-Y})\ O_4$ (wherein Y is in a range of $0.1 \leq Y \leq 1$).

The carrier core material constituting the carrier according to the present invention is added with P in a stage of a raw material powder. It can be considered that the added P moves to a surface of the carrier core material involving Mg in a sintering stage.

By movement of P and Mg as described above, Mg and P are precipitated on the surface of the carrier core material according to the present invention. Specifically, when the content of Mg in the carrier core material is expressed by M1, and an analysis value of Mg by EDS on the surface of the carrier core material is expressed by M2, a value of M2/M1 exceeds 1.0, or preferably is 1.05 or more, and Mg is precipitated on the surface of the carrier core material. Meanwhile, 0.1 mass % or more of P is also precipitated on the surface of the carrier core material.

Namely, much Mg and P are precipitated on the surface of the carrier core material constituting the carrier of the present invention, compared with a ferrite phase of inside. Then, it can be considered that a charging amount of the carrier core material itself is increased, due to separation of Mg and P on the surface, and the charging amount can be maintained for a long time.

(A Method for Manufacturing the Carrier Core Material Constituting the Carrier According to the Present Invention)

(Raw Material)

$Fe_2O_3$, etc., can be suitably used as a Fe supply source of the soft ferrite that constitutes the carrier core material. As Mg supply source, a compound of one kind or more selected from MgO, $Mg(OH)_2$/and $MgCO_3$ can be suitably used as the Mg supply source.

Meanwhile, $MnCO_3$ and/or $Mn_3O_4$, etc., can be suitably used as a Mn-source of a soft ferrite.

The Fe supply source will be described first.

An average particle size of $Fe_2O_3$, being a main raw material of the carrier core material, is preferably 1 μm or more and 5 μm or less, and further preferably 1.5 μm or more and 3 μm or less. The average particle size is measured by a MICROTRAC HRA 9320-X100 (by NIKKISO CO., LTD.)

When the average particle size of $Fe_2O_3$, being the main raw material, is 1 μm or more and preferably 1.5 μm or more, a suitable grain boundary is formed, with no excessive dense granulated substances which are formed by granulating the $Fe_2O_3$. Then, it can be considered that Mg and P can be easily precipitated on the surface of the carrier core material through the grain boundary of the granulated substances.

Meanwhile, when the average particle size of $Fe_2O_3$ is 5 μm or less and preferably 3 μm or less, carrier particles can be easily formed into a spherical shape in a granulating process as will be described later.

The Mn supply source and the Mg supply source will be described next, and they are described in a case that Mn is contained or is not contained in the soft ferrite that constitutes the carrier core material.

First, explanation will be given for a case that the carrier core material is mainly composed of the soft ferrite expressed by $(Mg_XMn_{1-X})Fe_2O_4$ (wherein X is in a range of $0.1 \leq X < 1$.).

The Mg-source, being a raw material, is preferably set to 1.0 mass % or more and 12 mass % or less in terms of element Mg, and the Mn-source, being a raw material, is preferably set to 2.5 mass % or more and 25 mass % or less in terms of element Mn, with respect to a total amount of $Fe_2O_3$, being a main raw material of the carrier core material, and the other metal oxide for composing a ferrite together with $Fe_2O_3$. Preferably, element Mg is set to 1.2 mass % or more and 10 mass % or less, and element Mn is set to 10 mass % or more and 23 mass % or less, and further preferably element Mg is set to 1.5 mass % or more and 5 mass % or less, and element Mn is set to 15 mass % or more and 21 mass % or less.

When an amount of the element Mg constituting the carrier core material is 1.0 mass % or more, and preferably 1.2 mass % or more, an amount of Mg precipitated on the surface of the carrier core material from the grain boundary can be guaranteed, and a desired charging amount can be obtained.

Meanwhile, when the amount of the element Mg constituting the carrier core material is 12 mass % or less, and preferably 10 mass % or less, a desired magnetic force as the carrier core material can be obtained.

Further, when the amount of the element Mn constituting the carrier core material is 2.5 mass % or more, and preferably 10 mass % or more, a desired magnetic force as the carrier core material can be obtained.

Meanwhile, when the amount of the element Mn constituting the carrier core material is 25 mass % or less, and preferably 23 mass % or less, the amount of Mg precipitated on the surface of the carrier core material from the grain boundary can be guaranteed, and a desired charging amount can be obtained.

Next, explanation will be given for a case that the carrier core material is mainly composed of the soft ferrite expressed by $(Mg_YFe_{3-Y})O_4$ (wherein Y is in a range of $0.1 \leq Y \leq 1$).

The Mg-source, being a raw material, is preferably set to 1.0 mass % or more and 12 mass % or less in terms of element M, with respect to a total amount of $Fe_2O_3$, being a main raw material of the carrier core material, and the other metal oxide for composing the ferrite together with the $Fe_2O_3$. Preferably, the element Mg is set to 1.2 mass % or more and 10 mass % or less, and further preferably set to 1.5 mass % or more and 5 mass % or less.

When the amount of the element Mg constituting the carrier core material is 1.0 mass % or more and is preferably 1.5 mass % or more, the amount of Mg precipitated on the surface of the carrier core material from the grain boundary can be guaranteed, and a desired charging amount can be obtained.

Meanwhile, when the amount of the element Mg constituting the carrier core material is 12 mass % or less and is preferably 10 mass % or less, the ferrite can be constituted, and a desired magnetic force as the carrier core material can be obtained.

Finally, P added to the carrier core material will be described.

Element P added to the carrier core material can be added in a range of 0.1 mass % or more and 10 mass % or less, with respect to the total amount of $Fe_2O_3$, being the main raw material of the carrier core material, and the other metal oxide for composing the ferrite together with the $Fe_2O_3$. When an addition of the element P is 0.1 mass % or more, a moving effect to the surface of the carrier core material involving Mg can be obtained. Meanwhile, when the addition of the element P is 10 mass % or less, the following situation can be prevented: carrier core materials are sintered with each other in the sintering process of the manufacturing step of the carrier core material, to thereby break the sintered carrier core material particles at the time of disintegrating, and a spherical shape can not be maintained. Note that a desired addition of the element P is 0.2 mass % or more and 6 mass % or less, and further preferably 1 mass % or more and 6 mass % or less from a viewpoint of the moving effect to the surface of the carrier core material involving Mg.

Added P is not particularly limited, and may be in a state of red phosphorus, in a state of phosphorus oxides such as $P_2O_5$, and may be in a state of phosphate such as $Ca_5(PO_4)_3$. For example, the red phosphorus produced by RINKAGAKU KOGYO CO., LTD is preferably used.

(Slurrying)

0.1 to 10 mass % of P-source is weighed in terms of element P, 2.5 to 25 mass % of Mn-source is weighed in terms of element Mn, 1.0 to 12 mass % of Mg-source is weighed in terms of element Mg, and $Fe_2O_3$ having average particle size of 1 μm or more and 5 μm or less is weighed as a remaining portion, so as to coincide with a target composition of the soft ferrite, to thereby obtain a metal raw material mixture.

The obtained metal raw material mixture is converted to slurry by mixing and stirring it in a medium solution (slurring step). A dry-type pulverizing process may be added to a raw material mixture as needed before the slurring step. A mixing ratio of the raw material powder and the medium solution is preferably set, so that concentration of a solid content in the slurry is 50 to 90 mass %.

The medium solution to be used is obtained by adding binder and dispersant, etc., to water. As the binder, for example polyvinyl alcohol is suitably used, and the concentration of the medium solution is set to about 0.5 to 2 mass %. For example, ammonium polycarboxylate is suitably used as the dispersant, and its concentration in the medium solution may be set to about 0.5 to 2 mass %. In addition, boric acid, etc., can also be added as a lubricant or a sintering promoting agent.

A wet-type pulverization is preferably applied to the slurry obtained by mixing and stirring.

As described above, the addition of P is 0.1 mass % or more and 10 mass % or less in terms of element P, and preferably in a range of 0.2 mass % or more and 6 mass % or less, and further preferably 1 mass % or more and 6 mass % or less, with respect to the metal raw material mixture, and is set corresponding to a target charging amount in the carrier core material.

However, the addition of P is very small compared with an amount of the metal raw material mixture. Therefore, a uniform dispersion state can be easily obtained by previously dispersing P in the medium solution. An order of dispersion of the metal raw material mixture and P into the medium solution may be reversed or may be simultaneous. However, in this case, dispersability of P may be increased by sufficiently stirring the slurry or increasing the number of times of wet-type pulverization.

(Granulation)

Granulation can be suitably executed by introducing the slurry into a spray drier. An atmosphere temperature during spraying and drying may be set to about 100 to 300° C. Thus, granulated powder having particle size of about 10 to 200 μm can be obtained (granulating step). A particle size of the obtained granulated powder is preferably adjusted by removing a coarse grain or fine powder in advance, using a vibrating sieve, etc., in consideration of a product final particle size.

(Sintering)

Next, the granulated powder is charged into a furnace heated to about 700 to 1500° C., which is then sintered by a general technique of synthesizing the soft ferrite, to thereby generate the ferrite (sintering step). When a sintering temperature is 700° C. or more, sintering is progressed to a certain degree, so that a shape can be maintained. When the sintering temperature exceeds 1500° C., excessive sintering of particles does not occur, and deformed particles are not generated. From this point of view, the sintering temperature is preferably set to about 700 to 1500° C. for sintering the granulated powder.

Further, a magnetic force of a sintered product, and carrier powder characteristics such as an electric resistance, are influenced by a sintering atmosphere. Particularly the magnetic force is greatly influenced by the kind of the ferrite, and therefore an oxygen concentration in the sintering furnace is preferably set to 5 mass % or less.

The particle size of the obtained sintered material is preferably adjusted in this sintering and completion process. For example, the sintered material is roughly pulverized by a hammer mill, etc., then is primarily classified by an air flow classifying machine, and further the particle size is made even by a vibrating sieve or an ultrasonic sieve, to thereby obtain the sintered material with particle size adjusted. After the particle size is adjusted, the sintered material is preferably further subjected to processing by a magnetic separator, to thereby remove a nonmagnetic particle.

(Resistance Increasing Treatment)

It is also preferable that resistance increasing treatment such that a resistance increasing layer is formed by heating the sintered material in an oxidizing atmosphere, is applied (resistance increasing treatment step). Heating atmosphere may be set as mixed atmosphere of oxygen and nitrogen. A heating temperature may be set to 200 to 800° C., preferably 250 to 600° C., and a processing time may be set to 30 minutes to 5 hours.

Thus, the carrier core material of the present invention can be obtained.

(Manufacture of a Carrier)

Resin coating is applied to the obtained carrier core material. As a system of coating, a dry process, a fluidized bed, and an immersion process, etc., can be used. The immersion process and the dry process are preferable, from a viewpoint of filing inside of the carrier with resin.

The immersion process is taken as an example to explain here. Silicone resin and acrylic resin are preferable as the coating resin. About 20 to 40 mass % of coating resin is dissolved into a solvent (such as toluene), to thereby prepare a resin solution. A coating operation can be performed by mixing obtained resin solution and the carrier core material in a vessel, so that a solid content is included in a range of 0.7 to 10 mass %, and thereafter heating and stirring a mixture at 150 to 250° C. An amount of the coating resin can be controlled by a concentration of the resin solution and a mixing ratio of the resin solution and the carrier core material. After the end of the resin coating, further heat treatment is applied thereto and a resin coating layer is cured, to thereby obtain a carrier according to the present invention.

(Manufacture of an Electrophotographic Developer)

An electrophotographic developer according to the present invention can be obtained by mixing the obtained carrier of the present invention into a toner having a suitable particle size.

EXAMPLES

The present invention will be specifically described hereafter based on examples. However, the present invention is not limited to the examples.

Example 1

$Fe_2O_3$ pulverized into average particle size $D_{50}$ of about 1.8 μm, and MgO, $Mn_3O_4$, P (red phosphorus by RINKAGAKU KOGYO Co., LTD.) powder pulverized into average particle size of about 1 μm, were prepared, as raw materials. The raw materials were mixed in a percentage of $Fe_2O_3$:71.2 mass %, $Mn_3O_4$:23.7 mass %, and MgO: 5.1 mass % respectively. Powder P was weighed in a percentage of 0.25 mass % in terms of element P, with respect to the amount of $Fe_2O_3$, MgO, $Mn_3O_4$ mixed raw material powder.

Meanwhile, a solution (medium solution) was prepared, which was obtained by adding 1.0 mass % of polycarboxylic acid ammonium-based dispersant as a dispersant, and 0.05 mass % of "SN wet 980" by SAN NOPCO LIMITED as a wetting agent, and 0.02 mass % of polyvinyl alcohol as a binder, into water as a dispersion medium.

Powder P was charged into the medium solution and was diffused sufficiently, then the weighed $Fe_2O_3$, MgO, $Mn_3O_4$ mixed raw materials powder was charged and stirred therein, to thereby obtain a slurry in which a concentration of the charged materials was 76 mass %.

The slurry was subjected to wet-type pulverization in a wet-type ball mill, and was stirred for a while, and thereafter was sprayed into hot blast of about 180° C. by a spray drier, to thereby obtain a dry a granulated substance having a particle size of 10 to 100 μm.

Coarse grains were separated from the granulated substance, using a vibration sieve having a mesh of 63 μm, then particulates were separated using the vibration sieve having a mesh of 33 μm, and thereafter sintering was performed for 5 hours at 1150° C. in a nitrogen atmosphere, and a sintered material was ferritized. The ferritized sintered material was disaggregated by a hammer mill, to thereby remove the particulates using an air classifier. The carrier core material according to example 1 was obtained through the aforementioned steps. Addition of an additive agent of the carrier core material and powder characteristic, magnetic characteristic, and evaluation test results as will be described later are shown in table 1.

Further, FIG. 1 shows a 4000 magnification SEM image of the carrier core material according to example 1, and a mapping image (b) of P, and a mapping image (c) of Mg of the same portion and the same magnification as those of the SEM image (a) by EDS.

Example 2

Similar operation as the operation of example 1 was performed excluding a point that added Powder P was weighed to be 0.5 mass % in terms of the element P, with respect to the amount of the $Fe_2O_3$, MgO, $Mn_3O_4$ mixed raw materials powder, to thereby obtain the carrier core material according to example 2.

Addition of the additive agent of the carrier core material, the magnetic characteristic, and the evaluation test result as will be described later, are shown in table 1.

Figure 2:
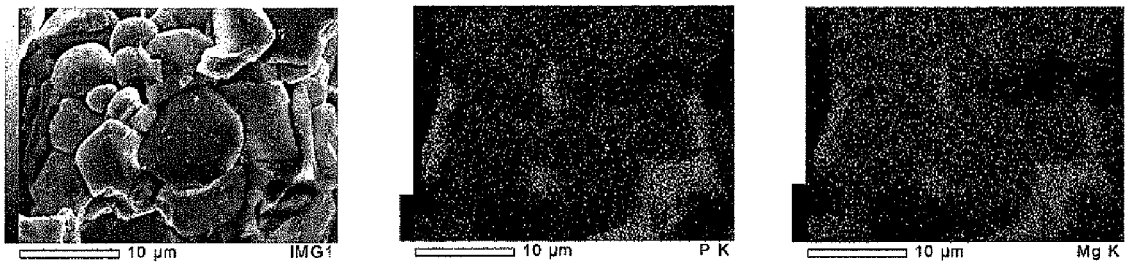
FIG. 2 shows a SEM image of a carrier core material, and a mapping image of P and Mg, according to example 2.

Further, FIG. 2 shows a 4000 magnification SEM image (a) of the carrier core material according to example 2, and a mapping image (b) of P, and a mapping image (c) of Mg of the same portion and the same magnification as those of the SEM image (a) by EDS.

Example 3

Similar operation as the operation of example 1 was performed excluding a point that added powder P was weighed to be 1.0 mass % in terms of the element P, with respect to the amount of the $Fe_2O_3$, MgO, $Mn_3O_4$ mixed raw materials powder, to thereby obtain the carrier core material according to example 3.

Addition of the additive agent of the carrier core material, the magnetic characteristic, and the evaluation test result as will be described later, are shown in table 1.

Figure 3:
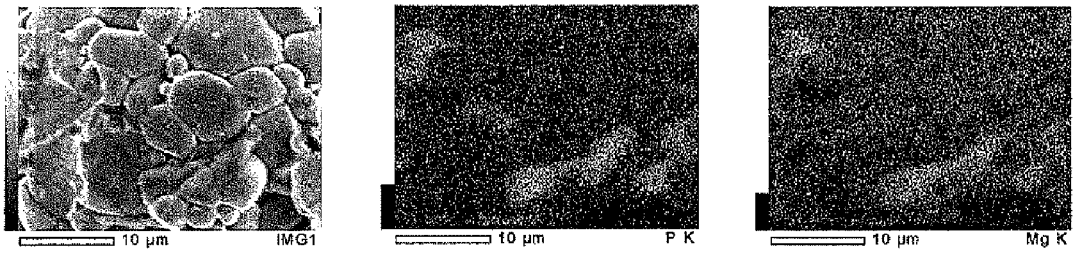
FIG. 3 shows a SEM image of a carrier core material, and a mapping image of P and Mg, according to example 3.

Further, FIG. 3 shows a 4000 magnification SEM image (a) of the carrier core material according to example 3, and a mapping image (b) of P, and a mapping image (c) of Mg of the same portion and the same magnification as those of the SEM image (a) by EDS.

Example 4

Similar operation as the operation of example 1 was performed excluding a point that $Fe_2O_3$ pulverized into average particle size $D_{50}$ of about 3.0 μm was used as a raw material, and the added powder P was weighed to be 5.0 mass % in terms of the element P, with respect to the amount of the $Fe_2O_3$, MgO, $Mn_3O_4$ mixed raw materials powder, to thereby obtain the carrier core material according to example 4.

Addition of the additive agent of the carrier core material, the magnetic characteristic, and the evaluation test result as will be described later, are shown in table 1.

Figure 4:
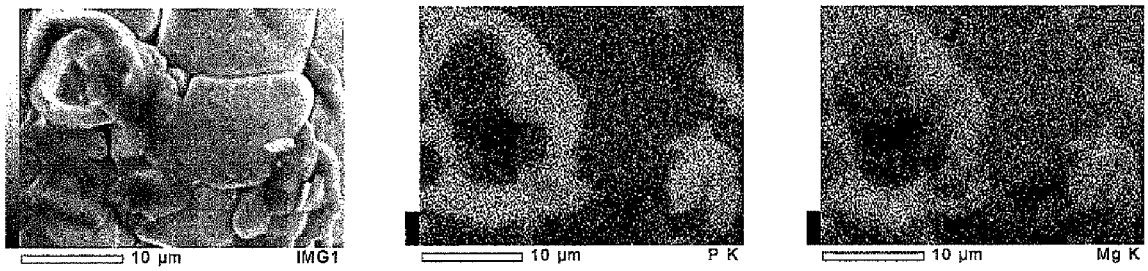
FIG. 4 shows a SEM image of a carrier core material, and a mapping image of P and Mg, according to example 4.

Further, FIG. 4 shows a 4000 magnification SEM image (a) of the carrier core material according to example 4, and a mapping image (b) of P, and a mapping image (c) of Mg of the same portion and the same magnification as those of the SEM image (a) by EDS.

Example 5

Similar operation as the operation of example 1 was performed excluding a point that added powder P was weighed to be 6.0 mass % in terms of the element P, with respect to the amount of the $Fe_2O_3$, MgO, $Mn_3O_4$ mixed raw materials powder, to thereby obtain the carrier core material according to example 5.

Addition amount of the additive agent of the carrier core material, the magnetic characteristic, and the evaluation test result as will be described later, are shown in table 1.

Figure 5:
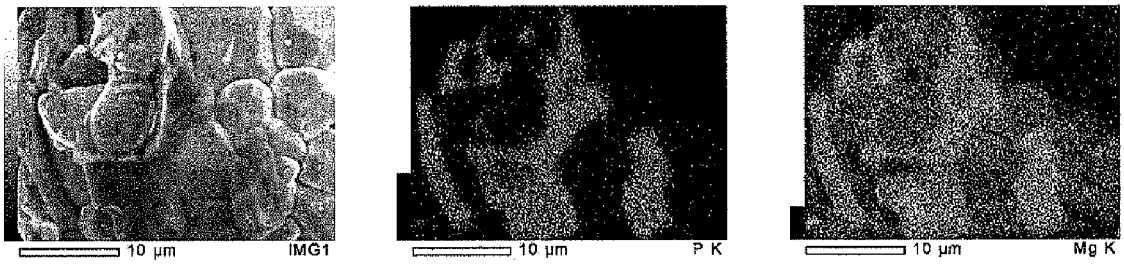
FIG. 5 shows a SEM image of a carrier core material, and a mapping image of P and Mg, according to example 5.

Further, FIG. 5 shows a 4000 magnification. SEM image (a) of the carrier core material according to example 5, and a mapping image (b) of P, and a mapping image (c) of Mg of the same portion and the same magnification as those of the SEM image (a) by EDS.

Example 6

$Fe_2O_3$, MgO were selected as raw materials, which were then mixed in a percentage of $Fe_2O_3$:96 mass %, MgO: 4 mass %, to thereby obtain $Fe_2O_3$, MgO mixed raw materials powder. Similar operation as the operation of example 1 was performed excluding a point that added powder P was weighed to be 0.2 mass % in terms of element P, with respect to the amount of the $Fe_2O_3$, MgO mixed raw materials powder, to thereby obtain the carrier core material according to example 6.

Addition amount of the additive agent of the carrier core material, the magnetic characteristic, and the evaluation test result as will be described later, are shown in table 1.

Figure 6:
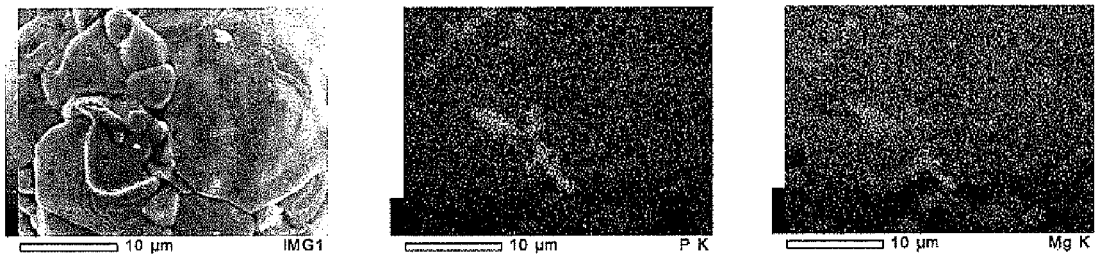
FIG. 6 shows a SEM image of a carrier core material, and a mapping image of P and Mg, according to example 6.

Further, FIG. 6 shows a 4000 magnification SEM image (a) of the carrier core material according to example 6, and a mapping image (b) of P, and a mapping image (c) of Mg of the same portion and the same magnification as those of the SEM image (a) by EDS.

Comparative Example 1

Similar operation as the operation of example 1 was performed excluding a point that granulation was performed without adding P to the $Fe_2O_3$, MgO, $Mn_3O_4$ mixed raw materials powder, to thereby obtain the carrier core material according to comparative example 1.

Addition of the additive agent of the carrier core material, the magnetic characteristic, and the evaluation test result as will be described later, are shown in table 1.

Figure 7:
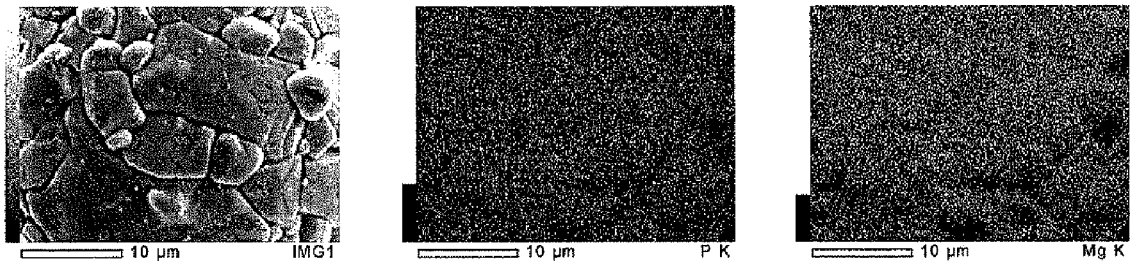
FIG. 7 shows a SEM image of a carrier core material, and a mapping image of P and Mg, according to comparative example 1.

Further, FIG. 7 shows a 4000 magnification SEM image (a) of the carrier core material according to comparative example 1, and a mapping image (b) of P, and a mapping image (c) of Mg of the same portion and the same magnification as those of the SEM image (a) by EDS.

Comparative Example 2

Similar operation was performed as the operation of example 1 excluding a point that $Fe_2O_3$ pulverized into average particle size $D_{50}$ of about 0.8 μm was used as the raw material, and added powder P was weighed to be 0.5 mass % in terms of element P, with respect to the amount of the $Fe_2O_3$, MgO, and $Mn_3O_4$ mixed raw materials powder, to thereby obtain the carrier core material according to comparative example 2.

Addition of the additive agent of the carrier core material, the magnetic characteristic, and the evaluation test result as will be described later, are shown in table 1.

Figure 8:
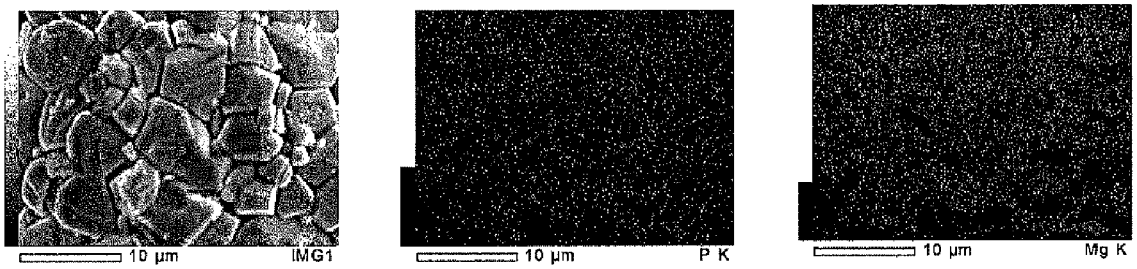
FIG. 8 shows a SEM image of a carrier core material, and a mapping image of P and Mg, according to comparative example 2.

Further, FIG. 8 shows a 4000 magnification SEM image (a) of the carrier core material according to example 6, and a mapping image (b) of P, and a mapping image (c) of Mg of the same portion and the same magnification as those of the SEM image (a) by EDS.

Comparative Example 3

Similar operation as the operation of example 6 was performed excluding a point that granulation was performed without adding P to the raw material, to thereby obtain the carrier core material according to comparative example 3.

Addition of the additive agent of the carrier core material, the magnetic characteristic, and the evaluation test result as will be described later, are shown in table 1.

Figure 9:
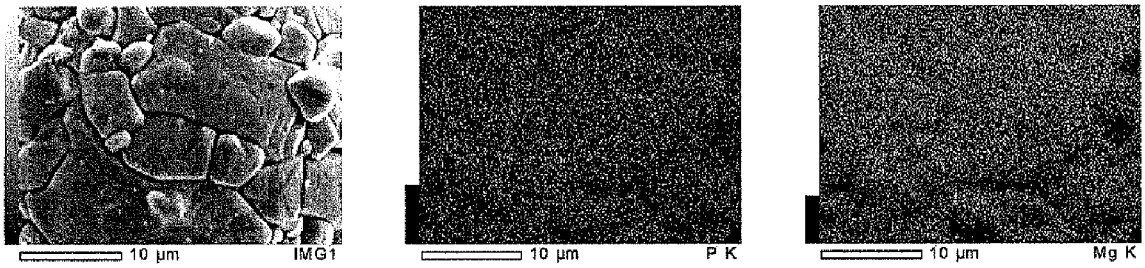
FIG. 9 shows a SEM image of a carrier core material, and a mapping image of P and Mg, according to comparative example 3.

Further, FIG. 9 shows a 4000 magnification SEM image (a) of the carrier core material according to comparative example 1, and a mapping image (b) of P, and a mapping image (c) of Mg of the same portion and the same magnification as those of the SEM image (a) by EDS.

Comparative Example 4

Similar operation as the operation of example 2 was performed excluding a point that granulation was performed using a mixed raw material powder in a percentage of $Fe_2O_3$: 71 mass % and $Mn_3O_4$:29 mass %, without adding MgO to the raw material, to thereby obtain the carrier core material according to comparative example 4.

Addition amount of the additive agent of the carrier core material, the magnetic characteristic, and the evaluation test result as will be described later, are shown in table 1.

Figure 10:
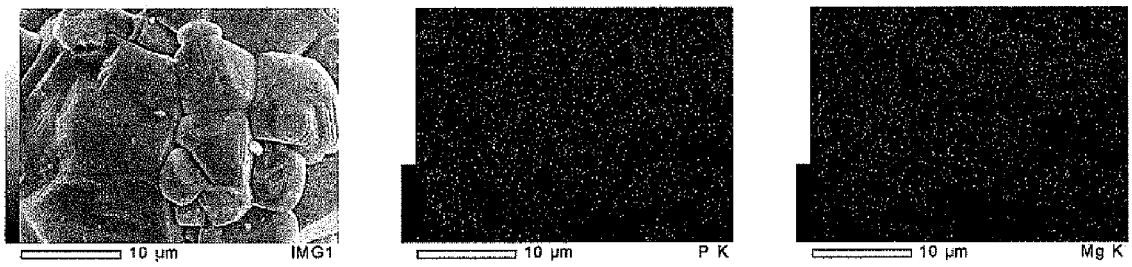
FIG. 10 shows a SEM image of a carrier core material, and a mapping image of P and Mg, according to comparative example 4.

Further, FIG. 10 shows a 4000 magnification SEM image (a) of the carrier core material according to comparative example 1, and a mapping image (b) of P, and a mapping image (c) of Mg of the same portion and the same magnification as those of the SEM image (a) by EDS.

(An Evaluation Test of a Charging Amount of the Carrier Core Material)

Charging characteristics of the carrier core material were estimated as the charging amount of the carrier core material, by shaking a mixture of the carrier core material and a toner so that the toner is electrified, and measuring an electric charge of the electrified toner.

First, 9.5 g of the carrier core material according to examples 1 to 6, and comparative examples 1 to 4, and 0.5 g of a commercially available toner (monochromatic toner with particle size of about 10 μm) were charged into a glass bottle, then the glass bottle was set in a shaking machine and was stirred for 30 minutes. Next, 0.5 g of a sample after stirring was weighed and taken out, and was placed and sucked on a SUS mesh having 500 meshes, to thereby separate only the toner from the sample after stirring. Then, the charging amount of the toner was measured, and a measured value thus obtained was set as an estimated value of the charging amount of the carrier core material. The charging amount was measured by using STC-1-C1 model by Japan Piotech Corporation.

(Measurement of Mg-content in the Carrier Core Material)

Mg-content in the carrier core material was measured by using ICPS-7510 by Shimadzu Corporation. As an analysis method, 1 g of a sample was measured, and was decomposed into 50 ml of hydrochloric acid. Then, 10 ml of yttrium (25 ppm) was added as a reference element, to thereby obtain a constant solution as a measurement sample. Further, 3 to 4 solutions of this sample were prepared, and an arbitrary amount of Mg was continuously added thereto, to thereby obtain an analytical curve sample. A relationship line between concentration series and light emission intensity was set as an analytical curve, to thereby measure the Mg-content in the carrier core material.

(Quantitative Analytic Measurement of Mg and P on the Surface of the Carrier Core Material)

A quantitative analysis value of Mg and P on the surface of the carrier core material was obtained by EDS using SEM-EDS measurement apparatus (JSM-6510LA model by JEOL Ltd.).

The measurement apparatus was adjusted so that only one particle of the carrier core material was included in a visual field of a 4000 magnification photograph, and element content (mass percentage) of Mg and P on the surface of the particle of the carrier core material was measured and obtained, using an overall visual field as a measurement area. Note that measurement was performed to 30 particles of the carrier core material, and an average value thereof was used as a measurement result.

(Manufacture of the Carrier According to Examples 1 to 6, and Comparative Examples 1 to 4)

The carrier core material obtained by the examples and the comparative examples was coated with resin by a method described hereafter.

First, silicone resin (KR251 by Shin-Etsu Chemical Co., Ltd.) was dissolved into toluene, to thereby prepare a coating resin solution. The coating resin solution and the carrier core material were charged into a stirring machine. At this time, the solid content in the coating resin solution was set in a percentage of 3 mass % of the carrier core material.

Then, the carrier core material was heated and stirred in a temperature range of 150 to 250° C. while being immersed into the resin solution for 3 hours. Thus, the resin was coated in a percentage of 3.0 parts by mass, with respect to 100 parts by mass of the carrier core material.

The resin-coated carrier core material was heated for 5 hours at 250° C. by a hot air circulation type heater so that a resin coated layer was cured, to thereby obtain the carrier according to examples 1 to 6 and the comparative examples 1 to 4.

(An Evaluation Test of a Variation Over Time in the Charging Amount of the Carrier)

Similarly to the evaluation of charging of the carrier core material, 9.5 g of the carrier and 0.5 g of a commercially available toner (monochromatic toner with particle size of about 10 μm) were charged into the glass bottle. The glass bottle was set in the shaking machine, and a sample was stirred. Next, 0.5 g of the sample after stirring was weighed and taken out, and was placed and sucked on a SUS mesh having 500 meshes, to thereby separate only the toner from the sample after stirring. Then, the charging amount of the toner was measured, and a measured value thus obtained was set as an estimated value of the charging amount of the carrier core material.

A stirring time was set to 30 minutes and 24 hours, and a variation of the charging amount in this time lag was measured. Then, charging amounts of the samples of examples 1 to 6, and comparative examples 1 to 4 were expressed, with a sample of comparative example 1 after stirring for 30 minutes set to 1.0 as a standard.

The results of the evaluation test were shown in table 1.

surface of the carrier core material, through a large grain boundary generated by the $Fe_2O_3$ particle having a large particle size.

Then, as a result, when the content of Mg of the carrier core material according to the present invention is expressed by M1, and the quantitative analytical measurement value, of Mg by EDS on the surface of the carrier core material (expressed by "EDS analysis value of Mg" according to the present invention in some cases) is expressed by M2, it can be considered that a sample with a value of M2/M1 being 1.0 or more, and the quantitative analysis value of P by EDS on the surface of the carrier core material (described as "EDS analysis value of P" according to the present invention in some cases) being 0.1 mass % or more, can be manufactured.

Figure 11:
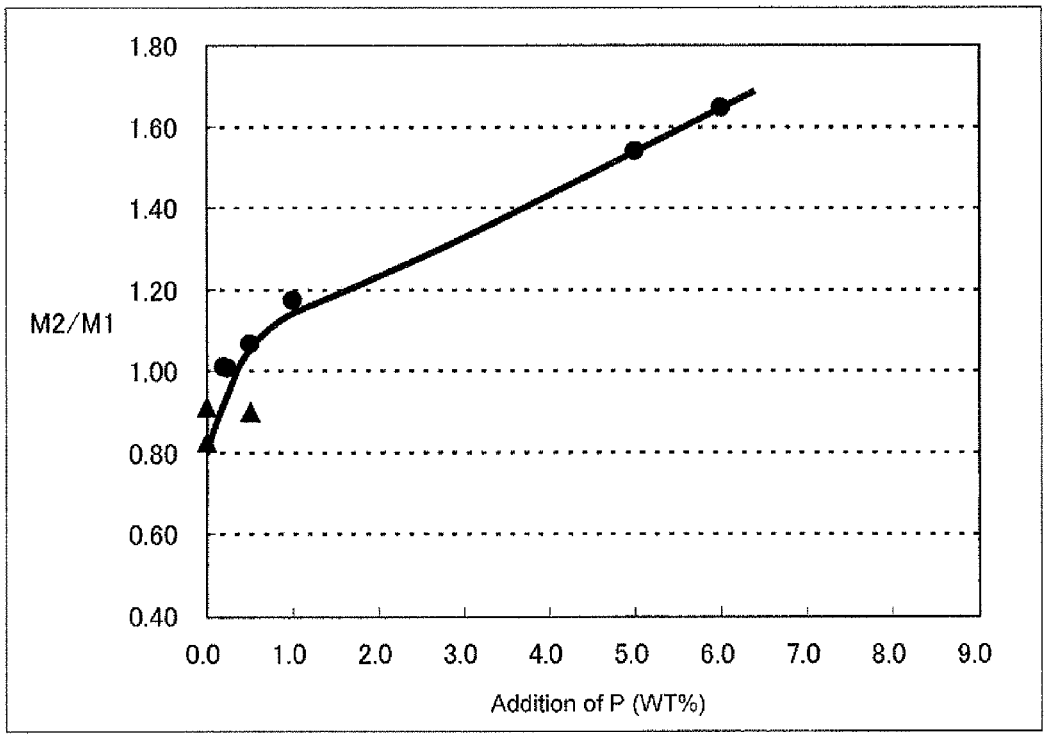
FIG. 11 is a graph showing a relation between addition of P, and Mg existence ratio inside of the carrier core material and on the surface of the carrier core material.

In order to confirm and examine an effect of moving P involving Mg to the surface of the carrier core material, from the inside of the carrier core material, M2/M1 obtained from data described in table 1 by dividing an EDS analysis value M2 of Mg on the surface of each carrier core material, by M1 being the content of Mg in the carrier core material, is taken on the vertical axis, and the addition of P to each carrier core material is taken on the horizontal axis, and values of the carrier of examples 1 to 6 and comparative examples 1 to 4 are plotted and shown in FIG. 11.

TABLE 1

| | Average particle size of $Fe_2O_3$ (μm) | Content of Mg (M1) (wt %) | Addition of P (wt %) | EDS analysis value Mg (M2) (wt %) | EDS analysis value P (wt %) | M2/M1 | Charging amount of carrier core material (μC/g) | Charging variation of carrier over time After 30 minutes (A) | Charging variation of carrier over time After 24 hours (B) | Charging variation of carrier over time (A) − (B) |
|---|---|---|---|---|---|---|---|---|---|---|
| Example 1 | 1.8 | 3.08 | 0.25 | 3.10 | 0.31 | 1.01 | 9.8 | 1.05 | 0.96 | 0.10 |
| Example 2 | 1.8 | 3.02 | 0.5 | 3.22 | 0.73 | 1.07 | 10.9 | 1.14 | 1.03 | 0.11 |
| Example 3 | 1.8 | 3.19 | 1.0 | 3.74 | 1.77 | 1.17 | 15.7 | 1.20 | 1.12 | 0.08 |
| Example 4 | 3.0 | 3.12 | 5.0 | 4.80 | 7.51 | 1.54 | 20.3 | 1.27 | 1.24 | 0.03 |
| Example 5 | 1.8 | 3.12 | 6.0 | 5.14 | 7.62 | 1.65 | 20.6 | 1.28 | 1.24 | 0.04 |
| Example 6 | 1.8 | 2.40 | 0.2 | 2.42 | 0.29 | 1.01 | 10.5 | 1.07 | 0.98 | 0.09 |
| Comparative example 1 | 1.8 | 3.15 | — | 2.60 | — | 0.83 | 6.5 | 1 (Standardization) | 0.84 | 0.16 |
| Comparative example 2 | 0.8 | 3.14 | 0.5 | 2.83 | 0.48 | 0.90 | 6.4 | 1.01 | 0.84 | 0.17 |
| Comparative example 3 | 1.8 | 2.40 | — | 2.19 | — | 0.91 | 5.4 | 0.99 | 0.82 | 0.17 |
| Comparative example 4 | 1.8 | — | 0.5 | 0.01 | 0.43 | — | 4.8 | 0.75 | 0.61 | 0.14 |

(Conclusion)

Regarding the carrier core material of the examples and the comparative examples in FIG. 1 to FIG. 10(*a*), (*b*), (*c*), the results of the quantitative analytic measurement by EDS performed to Mg and P on the surface of the carrier core material revealed that much Mg and P were precipitated on the surface of the carrier core material of the examples 1 to 6. Meanwhile, it was found that Mg was less precipitated on the surface of the carrier core material of comparative example 1 not added with P, and on the surface of the carrier core material of comparative example 2 using $Fe_2O_3$ having a small particle size. Further, from a measurement result of the charging amount of comparative example 4 not added with Mg, it can be considered that the charging amount of the carrier core material was improved owing to a cooperation effect of P and Mg.

From the result, it can be considered that when moisture evaporation of P occurs to the outside from the inside of the carrier core material in the sintering step, there is an effect of accompanying Mg to the surface of the carrier core material. Further, in the carrier core material of the example using $Fe_2O_3$ having particle size of 1.5 μm or more as a ferrite raw material, it can be considered that Mg and P are moved to the In addition, M2/M1 obtained by dividing the EDS analysis value M2 of Mg on the surface of each carrier core material, by M1 being the content of Mg in the carrier core material, is taken on the vertical axis, and the EDS analysis value of P on the surface of each carrier core material is taken on the horizontal axis, and the values of the carrier according to examples 1 to 6, and comparative examples 1 to 4 are plotted and shown in FIG. 12.

Figure 13:
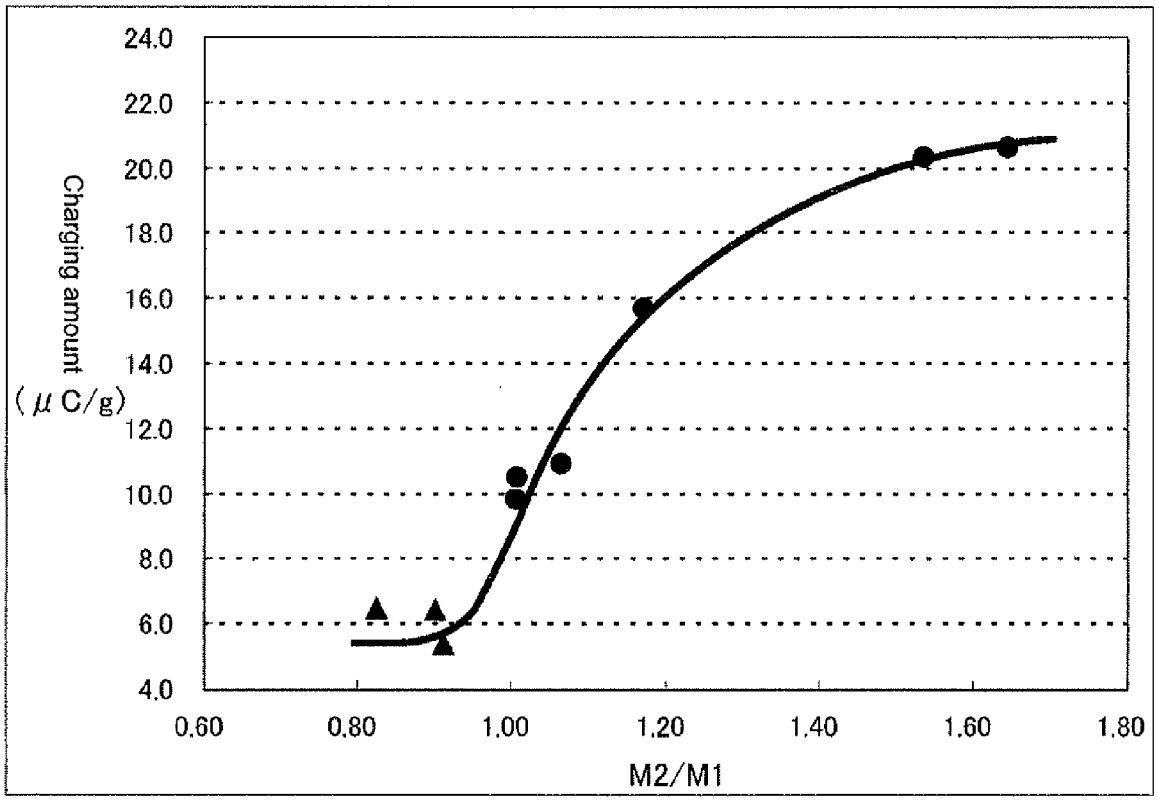
FIG. 13 is a graph showing a relation between Mg existence ratio inside of the carrier core material and on the surface of the carrier core material, and charging amount.

Next, in order to examine an effect of Mg moved to the surface of the carrier core material for the charging amount of the carrier core material, the charging amount of each carrier core material is taken on the vertical axis, and a value obtained by dividing the EDS analysis value of Mg on the surface of each carrier core material by the content of Mg in the carrier core material is taken on the horizontal axis, and the values of the carrier according to examples 1 to 6, and comparative examples 1 to 4 are plotted and shown in FIG. 13.

Figure 14:
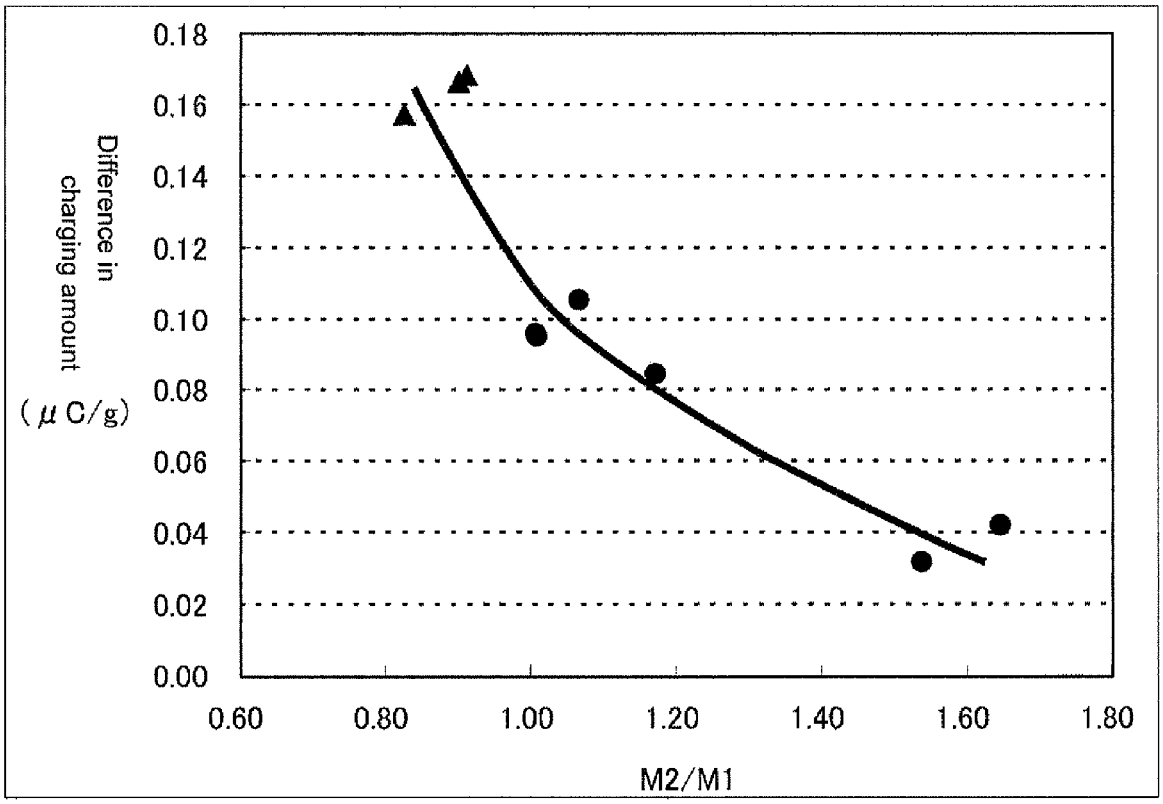
FIG. 14 is a graph showing a relation between Mg existence ratio inside of the carrier core material and on the surface of the carrier core material, and a variation of the charging amount over time.

In order to examine the effect of Mg moved to the surface of the carrier core material for the charging variation of the carrier core material over time from further another viewpoint, a difference in charging amount of the core material of each carrier (after 30 minutes-after 24 hours) is taken on the vertical axis, and a value obtained by dividing the EDS analysis value of Mg on the surface of each carrier core material, by the content of Mg in the carrier core material is taken on the horizontal axis, and the values of the carrier according to examples 1 to 6, and comparative examples 1 to 4 are plotted and shown in FIG. 14.

Figure 12:
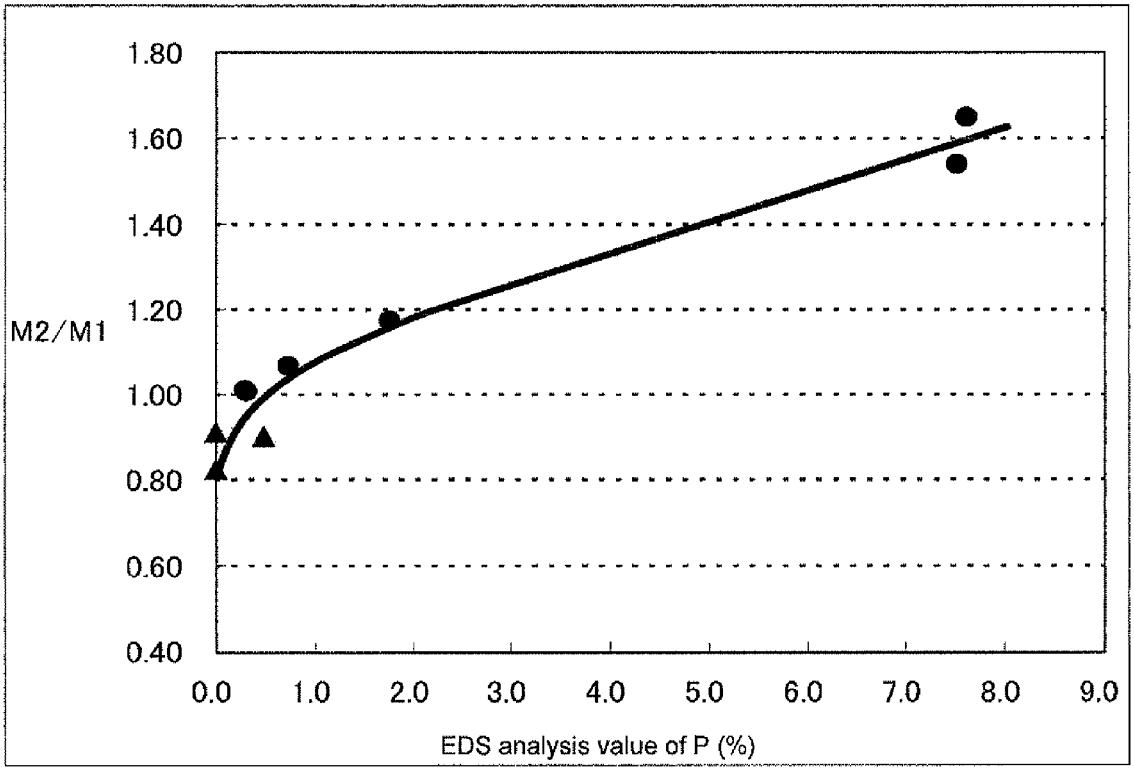
FIG. 12 is a graph showing existence of P on the surface of the carrier core material, and Mg existence ratio inside of the carrier core material and on the surface of the carrier core material.

From the plotted values of the carrier according to examples 1 to 6 of FIG. 11, a proportional relation was observed between M2/M1 obtained by dividing the EDS analysis value of Mg on the surface of each carrier core material by the content of Mg in the carrier core material, and the EDS analysis value of P on the surface of each carrier core material, in a range of 0.2 mass % to 6 mass % of the addition P to each carrier core material Further from FIG. 12, the proportional relation was also observed between M2/M1 obtained by dividing the EDS analysis value of Mg on the surface of each carrier core material and the EDS analysis value of P on the surface of each carrier core material, in a range of 0.3 mass % to 7.6 mass % of the EDS analysis value of P on the surface of each carrier core material.

From this result, it can be considered that the effect of moving P involving Mg to the surface of the carrier core material from the inside of the carrier core material can be confirmed.

It can be considered that an oxidized compound with Mg is formed by P, and Mg is moved to the surface of the carrier core material in a state of $Mg_3(PO_4)_2$.

Meanwhile, from a comparison result between example 2 and comparative example 2, it was found that a moving effect of Mg was low when the average particle size of $Fe_2O_3$ was small, even if a suitable amount of P existed. It can be considered that this is because when the average particle size of $Fe_2O_3$ is small, the formed grain boundary is also small, and it becomes difficult to move Mg.

Further, in a case of the comparative example 4 with no Mg added, the cooperation effect of P and Mg can not be obtained because Mg does not exist even if a suitable amount of P exists, and the charging amount is also low.

From the plotted values of the examples 1 to 6 and comparative examples 1 to 4 of FIG. 13, it was found that the charging amount of the carrier was raised sharp from a position where M2/M1 exceeds 1.0, which is obtained by dividing the EDS analysis value of Mg on the surface of each carrier core material by the content of Mg in the carrier core material, and the charging amount was 9.8 to 20.6 (μC/g). Further, it was found that an increase of M2/M1 was loose after 1.5.

Meanwhile, regarding the carrier according to comparative example 1 with no P added, M2/M1 was 0.83 and the charging amount was 6.5 (μC/g).

From the aforementioned result, it can be considered that the effect of M2/M1 for the charging amount of the carrier can be confirmed. Such an effect appears from the position where M2/M1 exceeds 1.0, and is approximately stable from the position where M2/M1 is 1.5 or more. Accordingly, it was also found that the charging amount of the carrier core material could be controlled to a target value by controlling the value of M2/M1.

From the plotted values of the carrier according to examples 1 to 6 and comparative examples 1 to 4 in FIG. 14, it was found that the difference in charging amount of each carrier core material (after 30 minutes to after 24 hours) was decreased by an increase of the value of M2/M1. As a result, for example, if the carrier with small variation of the charging amount over time is desired, the value of M2/M1 is preferably 1.5 or more.

Meanwhile, from the results of table 1 and FIGS. 13, 14, it was also found that there was a suitable composition range, responding to a request for the carrier core material of the present invention. Explanation will be given for an example of such a composition range hereafter.

1.) A Case of Obtaining a Difference Between High Charging Amount and Low Charging Amount When a difference between high charging amount and low charging amount is obtained in the carrier core material of the present invention, a composition range of the carrier core material according to examples 4, 5 is considered to be preferable. When the composition range is obtained from table 1, and FIGS. 11 to 14, the composition range is considered to be a range in which 3.0 to 3.5 mass % of Mg in terms of element Mg is added to $Fe_2O_3$ with average particle size $D_{50}$ being 1.7 to 3.2 μm, and 17.4 to 18.3 mass % of Mn in terms of element Mn is added thereto, and 4.5 to 6.5 mass % of P in terms of element P is added thereto.

2.) A Case that the Charging Amount is Desired to be Set to a Desired Value a. A case that the charging amount of the carrier core material of the present invention is set to 10 to 12 μC/g.

When the charging amount is set to 10 to 12 μC/g for the carrier core material of the present invention, the composition range of the carrier core material according to examples 1, 2, 6 is considered to be preferable. When the composition range is obtained from table 1, and FIGS. 11 to 14, this is considered to be a range in which 2.3 to 3.1 mass % of Mg in terms of element Mg is added to $Fe_2O_3$ with average particle size $D_{50}$ being 1.7 to 1.9 μm, and 18.1 to 19.5 mass % of Mn in terms of element Mn is added thereto, and 0.2 to 0.6 mass % of P in terms of element P is added thereto.

b. A case that the charging amount of the carrier core material of the present invention is set to 15 to 16 μC/g.

When the charging amount is set to 15 to 16 μC/g for the carrier core material of the present invention, the composition range of the carrier core material according to examples 3, is considered to be preferable. When the composition range is obtained from table 1, and FIGS. 11 to 14, this is considered to be a range in which 3.1 to 3.3 mass % of Mg in terms of element Mg is added to $Fe_2O_3$ with average particle size $D_{50}$ being 1.7 to 1.9 μm, and 17.8 to 18.1 mass % of Mn in terms of element Mn is added thereto, and 0.8 to 1.2 mass % of P in terms of element P is added thereto.

INDUSTRIAL APPLICABILITY OF THE INVENTION

The carrier for the electrophotographic developer according to the present invention has a high initial charging amount in a developing machine, and can be applied to the developing machine such as a copying machine and a printer, as a carrier capable of keeping a developed image quality by maintaining the charging amount under long-time use.

The invention claimed is:

1. A method for manufacturing a carrier core material for electrophotographic developer, comprising:

weighing P-source so as to be 0.1 to 10 mass % of element P, weighing Mg-source so as to be 1.0 to 12 mass % of element Mg, and weighing $Fe_2O_3$ with average particle size $D_{50}$ being 1.0 μm or more as a remaining portion, with respect to a total amount of $Fe_2O_3$ being a main raw material of the carrier core material and other metal oxides for comprising a ferrite together with $Fe_2O_3$;

adding and mixing the weighed P-source, the weighed $Fe_2O_3$ with average particle size $D_{50}$ being 1.0 μm or more, and the weighed Mg-source into a solvent, and converting them into slurry;

spraying the slurry into a hot blast, and obtaining granulated dry powder;

sintering the granulated dry powder; and applying heat treatment to the sintered granulated dry powder under a prescribed condition,

2. A method for manufacturing a carrier core material for electrophotographic developer, comprising:

weighing P-source so as to be 0.1 to 10 mass % of element P, weighing Mn-source so as to be 2.5 to 25 mass % of element Mn, weighing Mg-source so as to be 1.0 to 12 mass % of element Mg, and weighing $Fe_2O_3$ with average diameter $D_{50}$ being 1.0 μm or more as a remaining portion, with respect to a total amount of $Fe_2O_3$ being a main raw material of the carrier core material and other metal oxides for comprising a ferrite together with $Fe_2O_3$;

adding and mixing the weighed P-source, the weighed $Fe_2O_3$ with average particle size $D_{50}$ being 1.0 μm or more, the weighed Mn-source, and the weighed Mg-source into a solvent, and converting them into slurry;

spraying the slurry into a hot blast and obtaining granulated dry powder;

sintering the granulated dry powder; and applying heat treatment to the sintered granulated dry powder under a prescribed condition.

3. The method for manufacturing a carrier core material for electrophotographic developer according to claim 1, characterized by using red phosphorus as the P-source and one or more compounds selected from the group consisting of MgO, $Mg(OH)_2$, and $MgCO_3$ as the Mg-source.

4. The method for manufacturing a carrier core material for electrophotographic developer according to claim 2, characterized by using red phosphorus as the P-source, $MnCO_3$ and/or $Mn_3O_4$ as the Mn-source, and one or more compounds selected from the group consisting of MgO, $Mg(OH)_2$, and $MgCO_3$ as the Mg-source.

* * * * *